US008544288B2

(12) United States Patent
MacDonald

(10) Patent No.: US 8,544,288 B2
(45) Date of Patent: Oct. 1, 2013

(54) DEHUMIDIFICATION ENHANCEMENT VIA BLOWER CONTROL

(75) Inventor: Virginia N. MacDonald, Rockwall, TX (US)

(73) Assignee: Lennox Manufacturing Inc., Richardson, TX (US)

( * ) Notice: Subject to any disclaimer, the term of this patent is extended or adjusted under 35 U.S.C. 154(b) by 1919 days.

(21) Appl. No.: 11/537,905

(22) Filed: Oct. 2, 2006

(65) Prior Publication Data

US 2008/0078842 A1 Apr. 3, 2008

(51) Int. Cl.
*F25B 49/00* (2006.01)
*F25D 17/04* (2006.01)

(52) U.S. Cl.
USPC ..... 62/176.6; 62/176.1; 62/180; 62/186; 62/324.1; 236/44 A; 236/44 C; 236/44 R

(58) Field of Classification Search
USPC ..... 62/176.1, 176.6, 180, 186; 236/44 A, 236/44 C, 44 R
See application file for complete search history.

(56) References Cited

U.S. PATENT DOCUMENTS

| | | | | |
|---|---|---|---|---|
| 5,129,234 | A | 7/1992 | Alford | |
| 6,070,110 | A | 5/2000 | Shah et al. | |
| 2004/0118133 | A1* | 6/2004 | Maeda et al. | 62/93 |
| 2007/0261422 | A1* | 11/2007 | Crawford | 62/176.1 |

* cited by examiner

*Primary Examiner* — Frantz Jules
*Assistant Examiner* — Azim Abdur Rahim

(57) ABSTRACT

The present invention provides a method for enhancing dehumidification of a conditioned space, while optimizing the effectiveness of Indoor Air Quality (IAQ) devices that are present in the HVAC system. After the system compressor is shut off, the actual space humidity is compared to the desired humidity. If the actual humidity is very close to or lower than the desired level the indoor blower (air handler) is allowed to continue running. However, if the actual humidity is greater than the desired level by a specified amount, the blower is forced off for a period of time proportional to the difference between the actual and desired humidity. At the next compressor activation, the blower is allowed to run as normal.

7 Claims, 4 Drawing Sheets

DEHUMIDIFICATION ENHANCEMENT VIA BLOWER CONTROL

TECHNICAL FIELD

The present invention relates generally to air processing systems, and more specifically to a method for reducing re-evaporation of condensed moisture on the evaporator coil after the compressor is shut off.

BACKGROUND OF THE INVENTION

The effectiveness of most Indoor Air Quality (IAQ) devices is heavily dependent on the volume of conditioned air that is passed through them. However, an issue arises when dehumidification is needed in the same conditioned space.

Air processing systems including a thermostat and a two-speed compressor are well known. The compressor may be part of a conventional air conditioner or heat pump. The compressor is cycled ON and OFF and between a LOW and HIGH speed in accordance with the temperature of the enclosed space and the thermostatic demand signals. HIGH cooling speed operation typically results when the enclosure temperature exceeds the set temperature of the thermostat by an incremental temperature, such as 2° F.

Processed air is delivered to the enclosed space by a blower. With a heat pump, the blower typically has two speeds and operates at HIGH speed during cooling and LOW speed during heating, regardless of compressor speed.

The cooling mode humidity controls incorporated into these types of air processing systems are electromechanical monitors designed solely to control blower speed. Whenever relative humidity of the enclosed space exceeds the set point of an electromechanical humidistat, the LOW blower speed is maintained. Slower air movement increases dehumidification in the area of the "cold" inside compressor coil.

However, these electromechanical humidity monitors are inefficient and inexact. While humidity reduction is generally enhanced, the temperature of the enclosed space is often not preserved, leading to higher energy costs. Additionally, the relative humidity tolerance of such monitors is much too great to provide adequate control for proper comfort.

SUMMARY OF THE INVENTION

The present invention provides a method for enhancing dehumidification of a conditioned space, while optimizing the effectiveness of Indoor Air Quality (IAQ) devices that are present in the HVAC system. After the system compressor is shut off, the actual space humidity is compared to the desired humidity. If the actual humidity is very close to or lower than the desired level the indoor blower (air handler) is allowed to continue running. However, if the actual humidity is greater than the desired level by a specified amount, the blower is forced off for a period of time proportional to the difference between the actual and desired humidity. At the next compressor activation, the blower is allowed to run as normal.

BRIEF DESCRIPTION OF THE DRAWINGS

The novel features believed characteristic of the invention are set forth in the appended claims. The invention itself, however, as well as a preferred mode of use, further objects and advantages thereof, will best be understood by reference to the following detailed description of an illustrative embodiment when read in conjunction with the accompanying drawings, wherein:

DETAILED DESCRIPTION OF THE DRAWINGS

Figure 1:
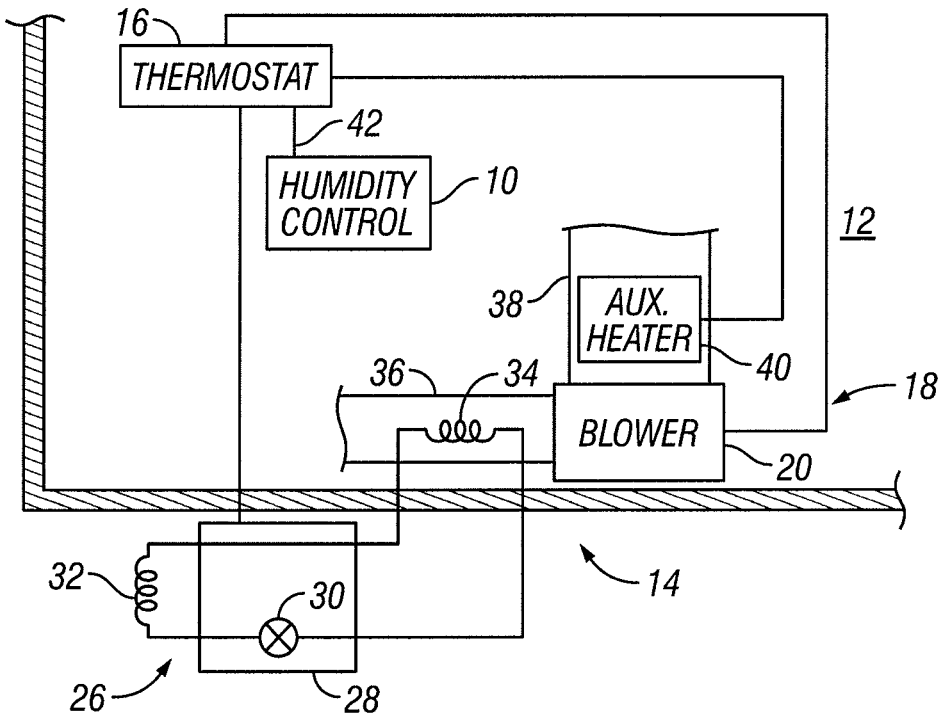
FIG. 1 is a schematic block diagram illustrating a conventional air processing system in which the present invention may be implemented.

With reference to the FIGS. 1-4, the present invention is shown as a control 10 for regulating the relative humidity level in an enclosure 12. The control 10 operates in conjunction with, and as a part of, a conventional air processing system 14, including a thermostat 16 and an air processor 18. The thermostat 16 is positioned within the enclosed space 12 and activates the air processor 18 in accordance with the enclosure temperature.

Figure 4:
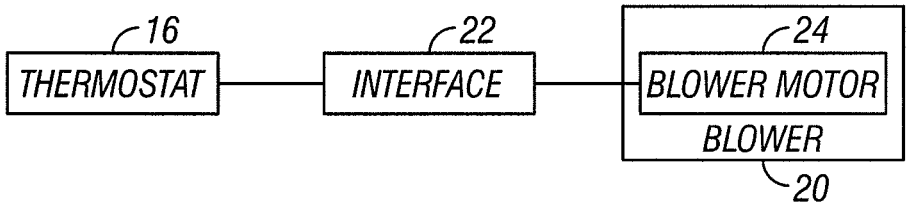
FIG. 4 is a schematic block diagram illustrating a constant volume blower incorporated into the air processing system shown in FIG. 1.

The air processing system 14 further includes a blower 20. A two-speed blower 20 is shown, but the control 10 is readily adapted for use with a constant volume blower such as shown in U.S. Pat. Nos. 4,806,833, 4,540,921, 4,169,990 and 4,005,347. With a constant volume blower 20, an interface 22 between the thermostat 16 and blower motor 24 is necessary, as shown in FIG. 4. One such interface 22 is shown in U.S. Pat. No. 5,220,255. The teachings of the aforementioned patents are incorporated herein by reference.

In the preferred embodiment, the air processor 18 comprises a heat pump 26 including a two-speed compressor 28. Alternatively, the air processor 18 may include a conventional two-speed air conditioner. The heat pump 26 in the present example has a reversing valve 30 for selection of the heating or cooling mode of operation. The compressor 28 includes an outside coil 32 and an inside coil 34.

The blower 20 delivers processed air to the enclosed space 12 via a supply duct 36 and draws room air via a return duct 38. The inside coil 34 communicates with the supply duct 36.

The thermostat 16 and air processor 18 operate in a conventional fashion to heat or cool the enclosure 12. In warm weather, the thermostat 16 activates first stage or LOW speed cooling whenever the enclosure temperature exceeds the thermostatic set point manually selected by the user (e.g., 74° F.). First stage cooling is achieved at HIGH blower speed and LOW compressor speed. Should the enclosure temperature exceed a second set point (e.g., 76° F.), a second stage cooling demand signal is issued by the thermostat 16. This results in HIGH blower speed and HIGH compressor speed.

Cold weather operation is similar. The reversing valve 30 is activated to provide a "hot" inside coil 34. The second set point in this mode of operation represents a temperature below the manually selected set point, and periodically the heat pump 26 is switched to the cooling mode to avoid freezing of the outside coil 32. During heating, the blower 20 is operated at a LOW speed, regardless of temperature demand.

The operation of the blower 20 and heat pump 26 is controlled by a series of sinusoidal demand signals, 24 VAC, from the thermostat 16. The demand signals include:

(i) a first stage demand signal, often referred to as the "M" signal;

(ii) a second stage demand signal, often referred to as the "M2" signal; and (iii) a reversing valve signal, often referred to as the "RV" signal.

In the preferred embodiment of the invention, the thermostat 16 also issues an auxiliary heat signal, often referred to as the "Y" signal, to activate a supplemental electric heater 40.

The compressor 28 is cycled ON and OFF by the thermostat 16. The air processor 18 provides the most efficient, i.e., least costly, cooling at LOW compressor speed and HIGH blower speed.

Figure 2:
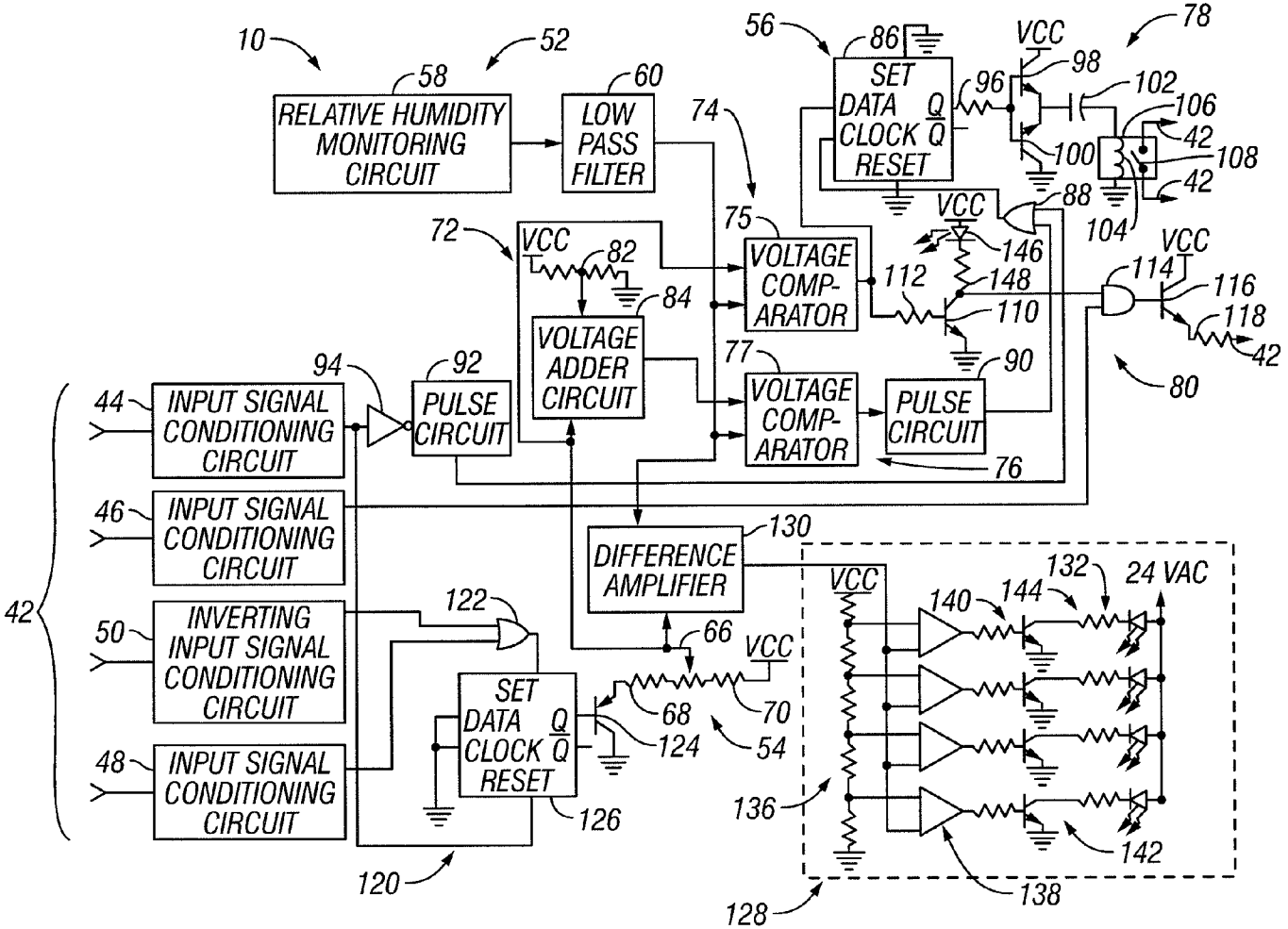
FIG. 2 is an electrical schematic block diagram of the present invention shown in FIG. 1.

In FIGS. 1 and 2, the humidity control 10 is shown as a part of the conventional air processing system 14. The humidity control 10, in response to relative humidity demand, manipulates operation of the compressor 28 to provide enhanced dehumidification and may override the thermostatic demand whenever the humidity demand is unsatisfied.

The humidity control 10 is coupled to the thermostat 16 by a multi-wire conductor 42. The control 10 receives the first stage demand, second stage demand, reversing valve and auxiliary heat signals via the conductor 42.

FIG. 2 is an electrical schematic block diagram of the present invention shown in FIG. 1. The first stage demand, second stage demand and auxiliary heat signals are received by input signal conditioning circuits 44, 46, 48, respectively. In the preferred embodiment the reversing valve signal is a 24 VAC signal during the cooling mode of compressor operation, and it is transformed and inverted by a conventional inverting input signal conditioning circuit 50.

The circuits 44, 46, 48, and 50 are conventional and convert the 24 VAC thermostatic signals into appropriate digital DC signals. Each circuit 44, 46, 48, 50 has a large amount of hysteresis to substantially avoid oscillation problems. Surge protection is also desirable.

The humidity control 10 includes a sensor 52, a selector 54, and a compressor controller 56. Sensor 52 senses actual relative humidity within the enclosed space and comprises a bulk polymer electronic relative humidity monitor 58 connected to a low pass filter 60. The output of the monitor 58 is a DC voltage ranging from 2 to 12 volts, proportionately representing 40% to 60% relative humidity. The filter 60 appropriately shapes the DC voltage such that the sensor 52 provides a slow-changing, substantially noise-free relative humidity signal.

Figure 3:
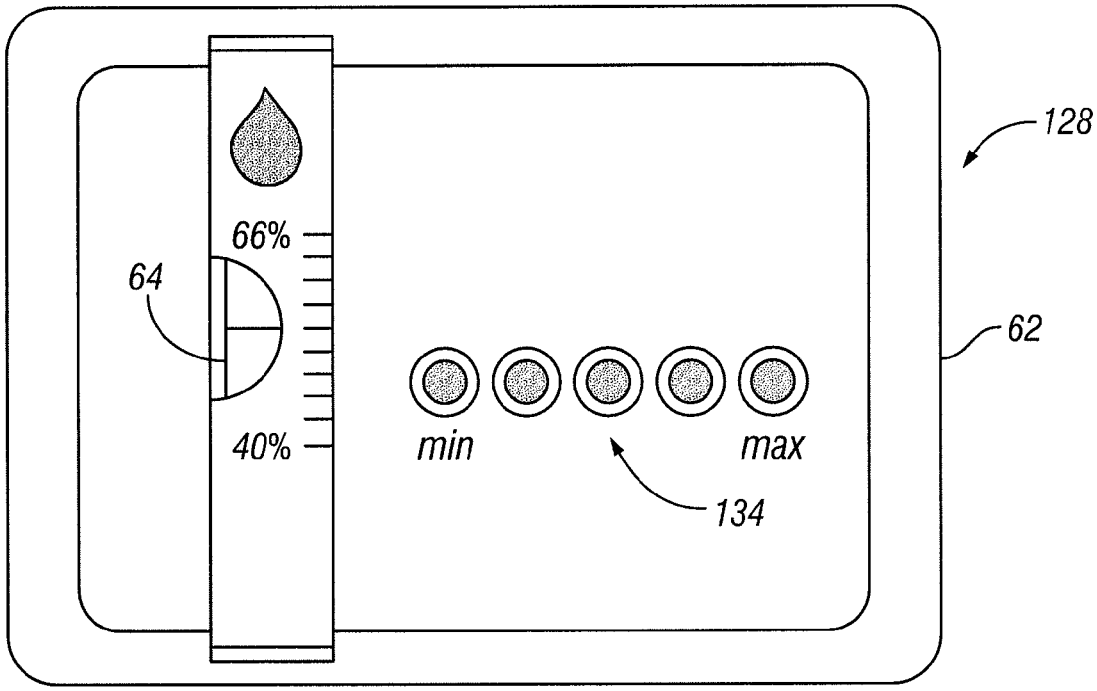
FIG. 3 is a front view of a housing including a relative humidity selector to be manually set by the user.

The selector 54 is manually adjusted to select the desired relative humidity level within the enclosed space. FIG. 3 illustrates an example selector, wherein the humidity control is incorporated into a housing 62 that is separate from the thermostat. In this example, the selector includes a slide 64 on the housing 62, which is manually set to a humidity level between 40% and 60%. In an alternate embodiment, the humidity control is incorporated within the housing of the thermostat.

Returning to FIG. 2, the selector 54 further includes a potentiometer 66, such that the selector 54 provides a DC set point signal representing a desired relative humidity level. The potentiometer 66 interposes two resistors 68, 70. Resistor 70 is connected to a control power supply, designated Vcc, which is preferably 15 VDC.

The compressor controller 56 is coupled and responsive to the sensor 52 and selector 54. The compressor controller 56 effects HIGH speed compressor operation under predetermined conditions to provide enhanced dehumidification and improved comfort.

The compressor controller 56 includes adjustment means 72, first comparator 74, second comparator 76, override means 78 and blower controller 80. The adjustment means 72 is coupled to the selector 54 and receives the set point signal. Its output is an adjusted signal, representing a relative humidity which exceeds the set point relative humidity by a predetermined increment (e.g., 2%) and defines the relative humidity threshold. In the preferred embodiment, the adjustment means 72 includes a voltage divider circuit 82, interconnecting the supply Vcc and ground and providing the appropriate DC voltage increment, and a voltage adder circuit 84. The voltage adder circuit 84 receives, as inputs, the set point signal and the voltage increment and responsively outputs the adjusted signal.

The first comparator means 74 is coupled to the sensor 52 and the selector 54 to receive the relative humidity signal and the set point signal thereof, respectively. The second comparator means 76 is coupled to receive the relative humidity signal and the adjusted signal.

The override means 78 is coupled to the thermostat, the first comparator means 74 and the second comparator means 76. Its inputs are the first stage demand or M signal, the first comparator signal and the second comparator signal. Responsively, the override means 78 issues an output signal which governs the compressor speed, regardless of thermostatic temperature demand and in accordance with humidity demand.

In general operational terms, the humidity control permits LOW speed compressor operation under supervision of the thermostat 16 unless:

(i) humidity rises above the humidity threshold defined by the adjustment means 72; or (ii) the compressor cycles OFF before actual relative humidity is reduced to the desired level.

The first event triggers immediate HIGH speed operation of the compressor; the second triggers HIGH speed beginning with the next ON cycle and continuing until the first comparator signal goes LOW and the humidity demand is met.

The blower controller 80 is coupled to receive the second stage demand signal from the thermostat 16 and an inversion of the first comparator signal from the first comparator means 74. As shown in FIG. 2, the blower controller 80 includes a transistor 110, and the base thereof is connected through a resistor 112 to the output of the first comparator means 74. The NPN transistor 110 is utilized to invert the first comparator signal for delivery to one input of an AND gate 114. The other input of the AND gate 114 receives the second stage demand signal.

The output of the AND gate 114 is connected to and controls the state of a transistor 116. The collector of the NPN transistor 116 is connected to the supply Vcc, and the emitter is connected through a resistor 118 to the conductor 42. The transistor 116 conducts whenever:

(i) second stage cooling is demanded by the thermostat 16 or forced by the humidity control 10; and (ii) the dehumidification demand is fully met (i.e., the first comparator signal is LOW representing an actual relative humidity below the level set by the selector 54).

Whenever the transistor 116 is conductive, the blower operates at HIGH speed.

Should the output of the first comparator means 74 reflect a demand, then the transistor 116 is rendered non-conductive and the blower is switched to LOW speed. This is accomplished via the conductor, through the resistor 118, the thermostat and, where necessary, the interface. The combination of HIGH compressor speed and LOW blower speed provides maximum dehumidification.

In addition to the dehumidification functions provided during compressor ON cycles described above, the present invention also enhances dehumidification via blower control when the compressor is in an OFF cycle.

The preferred embodiment of the present invention also includes display means 128 that visually displays the operational state of the control, showing whether the control is indeed operative and further showing the level of demand.

The display means 128 includes a difference amplifier 130, coupled to the sensor 52 and the selector 54, and a series of light-emitting diodes 132, visible through colored lens 134 arranged in a bar graph configuration on the housing. The display means 128 further includes a voltage divider circuit 136 and a series of comparators 138.

Each comparator 138 receives the output of the difference amplifier 130 at one input and one voltage from the divider circuit 136 at the other input. The comparator outputs are connected, respectively, through a series of resistors 140 to the bases of a series of transistors 142. The diodes 132 are connected, respectively, to the collectors of the transistors 142 through a series of resistors 144 and to the supply Vcc. The output of the difference amplifier 130 is a DC voltage proportional to the difference between actual relative humidity within the enclosed space and the desired humidity level. The voltage divider circuit 136 provides a series of DC voltages for comparison purposes, such that the number of comparators 138 issuing a HIGH output represents the extent or degree of dehumidification demand. A HIGH output from any comparator 138 causes illumination of the corresponding diode 132 by rendering the corresponding transistor 142 conductive.

Figure 5:
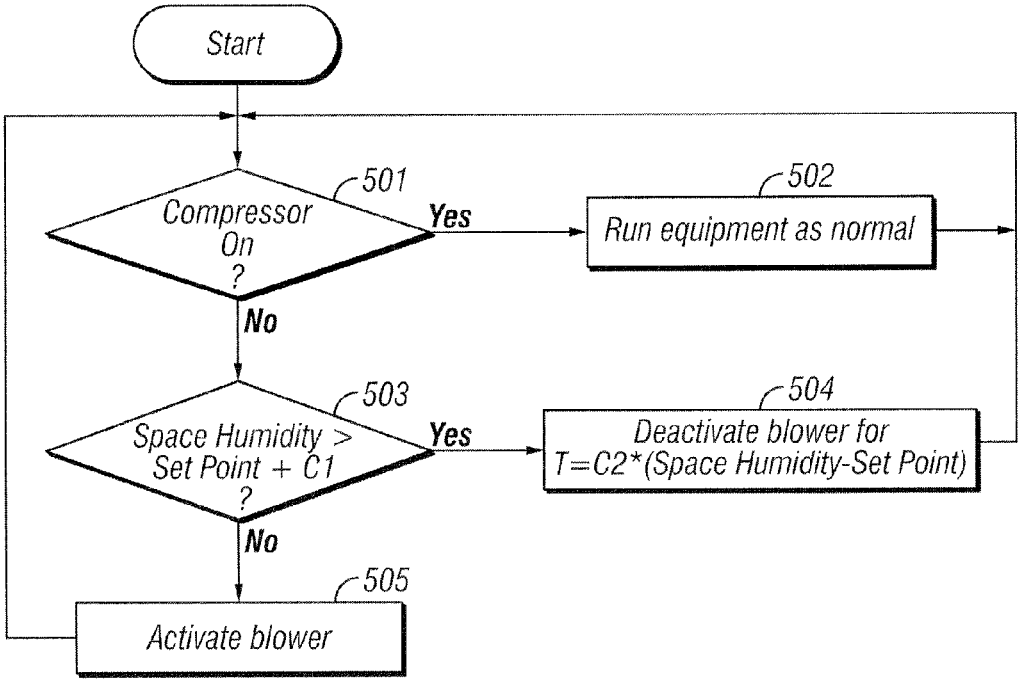
FIG. 5 depicts the process flow for enhanced dehumidification via blower control.

FIG. 5 depicts the process flow for enhanced dehumidification via blower control. The process begins by first determining if the compressor is on (step 501). If the compressor is in an ON cycle, the equipment runs normally as described above with references to FIGS. 1 and 2 (step 502).

If the compressor is in an OFF cycle, the blower control determines if the humidity in the enclosed space is greater than a predetermined amount (C1) over the set point chosen by the user (step 503). If the humidity level is equal to or less than the predetermined amount over the set point, the blower is allowed to continue running (step 505).

If the humidity level in the enclosed space exceeds the predetermined amount over the set point, the blower is deactivated (step 504). The blower is kept off for a period of time proportional to the difference between the actual humidity level and the set point. When the next compressor ON cycle commences, the blower is reactivated and allowed to run as normal. In this manner, the blower control can continue to influence humidity levels in the enclosed space during the interstitial periods between compressor ON cycles.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated. It will be understood by one of ordinary skill in the art that numerous variations will be possible to the disclosed embodiments without going outside the scope of the invention as disclosed in the claims.

I claim:

1. An apparatus for regulating humidity in an enclosed space using an air processing system that includes a thermostat, a compressor and a blower for providing processed air to said enclosed space, the apparatus comprising:

(a) a sensor for sensing actual humidity within the enclosed space and providing a humidity signal;

(b) a selector means for selecting a desired humidity level within said enclosed space and providing a set point signal; and (c) a blower control coupled to said sensor and selector means, wherein if the compressor is off, the blower control compares the actual humidity to the desired humidity, wherein:

(i) if the actual humidity is below the desired humidity, the blower control allows the blower to remain running; and (ii) if the actual humidity exceeds the desired humidity by less than a specified amount, the blower control allows the blower to remain running; and (iii) if the actual humidity exceeds the desired humidity by said specified amount, the blower control deactivates the blower for a period of time proportional to the difference between the actual and desired humidity.

2. The apparatus according to claim 1, wherein parts (a), (b), and (c) apply to relative humidity on the enclosed space.

3. The apparatus according to claim 1, wherein parts (a), (b), and (c) apply to absolute humidity of the enclosed space.

4. A method for regulating humidity in an enclosed space using an air processing system that includes a thermostat, a compressor and a blower for providing processed air to said enclosed space, the method comprising:

(a) sensing and calculating actual humidity within the enclosed space and providing a humidity signal;

(b) selecting a desired humidity level within said enclosed space and providing a set point signal;

(c) if the compressor is off, comparing the actual humidity to the desired humidity, and:

(i) if the actual humidity is below the desired humidity, allowing the blower to remain running;

(ii) if the actual humidity exceeds the desired humidity by less than a specified amount, allowing the blower to remain running; and (iii) if the actual humidity exceeds the desired humidity by said specified amount, deactivating the blower for a period of time proportional to the difference between the actual and desired humidity.

5. The method according to claim 4, wherein steps (a), (b), and (c) apply to relative humidity on the enclosed space.

6. The method according to claim 4, wherein steps (a), (b), and (c) apply to absolute humidity of the enclosed space.

7. The apparatus according to claim 1 wherein said air processing system includes a heat pump.

* * * * *